US006379066B1

(12) United States Patent
Gomez

(10) Patent No.: US 6,379,066 B1
(45) Date of Patent: Apr. 30, 2002

(54) GOLF BALL CLEANING APPARATUS

(76) Inventor: David P. Gomez, 6001 Sedgley Ct., Burr Ridge, IL (US) 60521

( * ) Notice: Subject to any disclaimer, the term of this patent is extended or adjusted under 35 U.S.C. 154(b) by 0 days.

(21) Appl. No.: 09/746,497

(22) Filed: Dec. 21, 2000

(51) Int. Cl.[7] ..... A47L 25/00

(52) U.S. Cl. ..... 401/6; 15/104.94; 15/244.4; 401/9; 401/118; 401/130; 401/202; 401/207; D3/225; D3/257

(58) Field of Search ..... 401/6, 9, 48, 118, 401/127, 130, 202, 207; 15/104.93, 104.94, 244.1, 244.4; 206/315.9; D3/225, 254, 257; D21/708, 715, 796

(56) References Cited

U.S. PATENT DOCUMENTS 1,820,256 A * 8/1931 Stewart ..... 15/244.4 X
4,974,763 A * 12/1990 Widrig ..... 15/21.2 X
5,131,112 A 7/1992 Cervini ..... 15/209
D366,685 S 1/1996 Faulk et al. ..... D21/234
5,524,311 A 6/1996 Crossley ..... 15/21.2
5,638,567 A 6/1997 Danyluk ..... 15/21.2
5,641,232 A 6/1997 Frey ..... 401/11
5,829,086 A 11/1998 Billek ..... 15/21.2
6,036,386 A 3/2000 McDonald ..... 401/10
6,148,464 A * 11/2000 Shioda ..... 15/244.1 X

* cited by examiner

*Primary Examiner*—Gregory L. Huson
*Assistant Examiner*—Kathleen J. Prunner
(74) *Attorney, Agent, or Firm*—Holland & Knight, LLP

(57) ABSTRACT

Disclosed is a cleaning apparatus that is adapted to be worn on the belt of a user. The apparatus permits its wearer to clean a golf ball at any point during a round of golf. The apparatus includes a water tight container with a hinged lid which houses a volume of cleaning fluid. A cleaning implement, such as a sponge, is removably positioned within the container such that it comes into contact with, and absorbs, the cleaning fluid. Thereafter, the implement can be removed from the container and used to clean the surface of a golf ball.

7 Claims, 3 Drawing Sheets

FIG 3
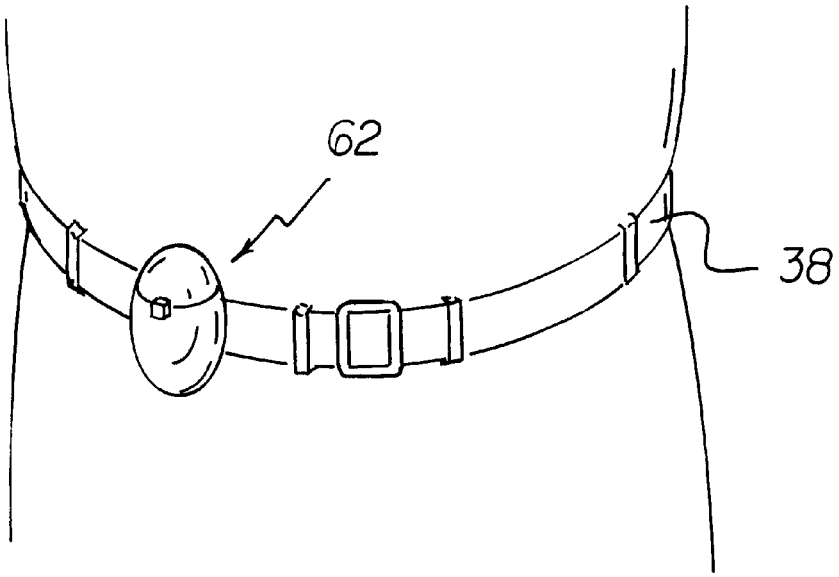
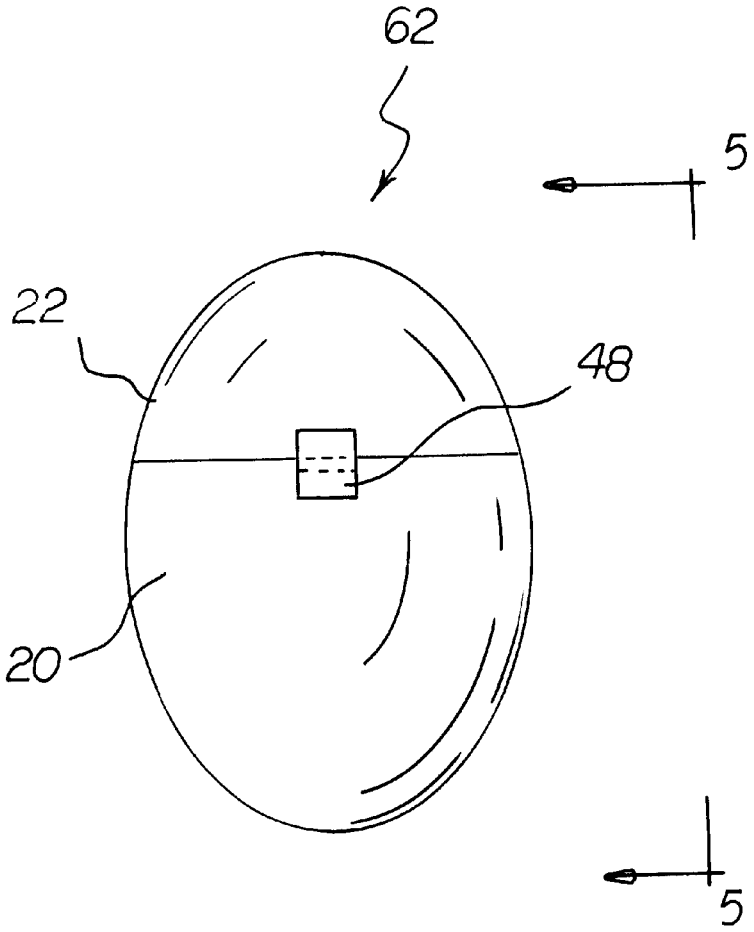
FIG 4

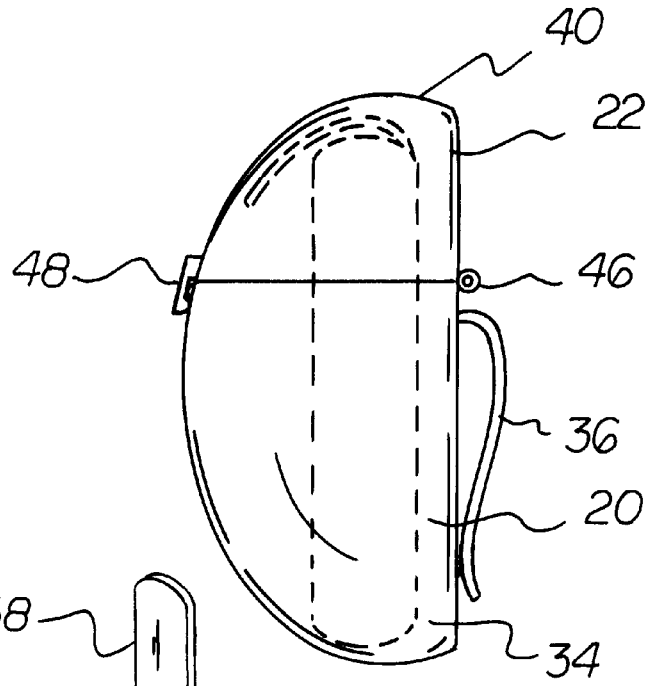
FIG 5
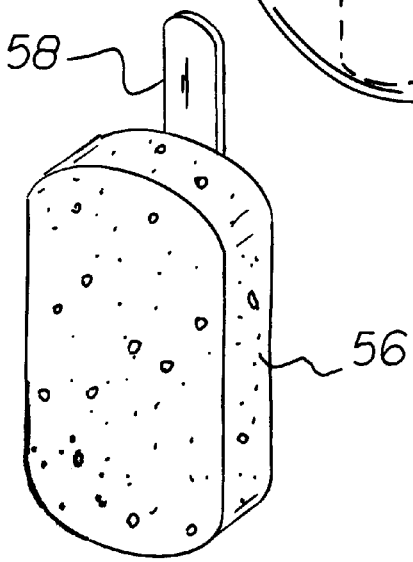
FIG 6
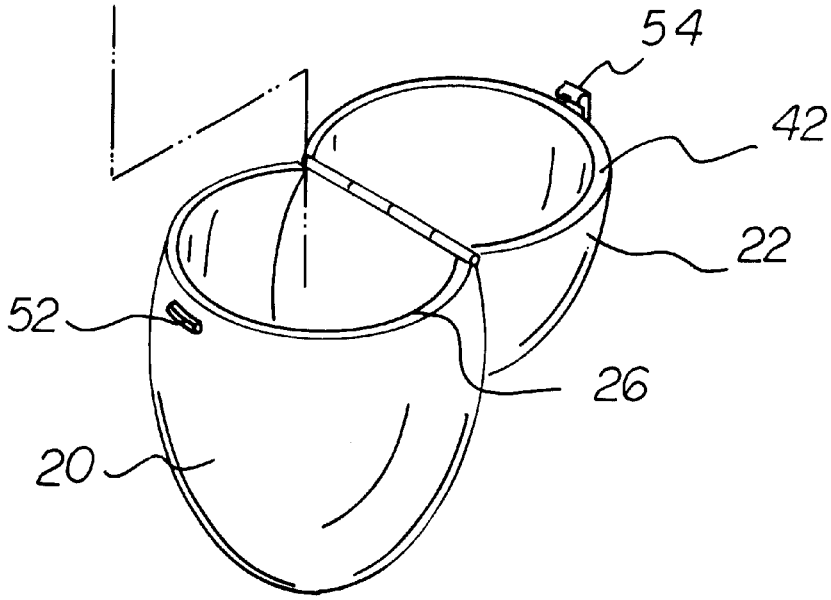

GOLF BALL CLEANING APPARATUS

BACKGROUND OF THE INVENTION

1. Field of the Invention

This invention relates to a cleaning apparatus. More particularly, the present invention relates to a belt worn container for carrying a sponge that is specifically adapted to clean the surface of a golf ball.

2. Description of the Background Art

The use of golf ball cleaners is known in the art. Such cleaners typically include a housing retaining a volume of fluid. The housing is mounted upon a post embedded within the ground. These golf ball cleaning devices are positioned at various locations around a golf course to allow users to clean their golf balls during a game of golf. However, such cleaning devices suffer a draw back insomuch as they are stationary. Consequently, users can wash their golf balls only at particular times and locations throughout the course of a golf game. As any golfer knows, golf balls become dirty and soiled at various times during a round of golf—not just when a player has access to a ball washer.

Golfers also fully understand the importance of clean golf balls. A clean ball is particularly desirable upon the putting surface. The precise nature of putting and the undesirable consequences of having dirt or debris upon a golf ball demand an unblemished ball. Unfortunately, stationary golf ball washers are very rarely located adjacent the putting green. As a consequence, there exists a need for portable golf ball washers which enable users to clean a golf ball at the time and location of their choosing.

The background art contains numerous examples of portable golf ball washers. For example, U.S. Pat. No. 6,036,386 to McDonald discloses a portable golf ball washer formed from two half spheres, each of the half spheres is fitted with a washer pad whereby the two pads may be made to move back and forth over the surface of a contained golf ball.

Similarly, U.S. Pat. No. 5,829,086 to Billek discloses a portable golf ball cleaner. The cleaner includes an outer liquid impermeable shell which is adapted to receive a liquid permeable chamber. The liquid permeable chamber, in turn, is configured to receive a golf ball. Reciprocal displacement of the contained golf ball with reciprocation of the closed container in an appropriate amount of cleaning fluid wets and brings the exterior surface of the ball into contact with scrubbing surfaces disposed upon the interior of the permeable chamber to thereby clean the ball.

U.S. Pat. No. 5,641,232 to Frey discloses a portable ball washer that includes a washer fluid reservoir within a sealed housing. A concave portion of the housing is uncovered and contains a moisture retaining pad whereby a ball can be pushed into the pad to permit the flow of washing fluid and the cleaning of the ball.

U.S. Pat. No. 5,638,567 to Danyluk discloses a golf ball washer. The washer includes a housing having interior walls lined by an abrasive ball cleaning medium. The washer further includes a plunger which includes a golf ball receiving aperture. The plunger is adapted to be movable between extended and retracted positions with respect to the interior of the cavity.

U.S. Pat. No. 5,524,311 to Crossley discloses a hand held golf ball washer. The washer includes a ball receiving chamber with a rotatable u-shaped brush positioned therein. The ball receiving chamber further includes a t-shaped stationary brush. A detergent solution is also adapted to be received within the ball receiving chamber. The detergent, rotating brush, and stationary brush all function to clean a golf ball positioned within the container.

Finally, U.S. Design Patent 366,685 to Faulk, et al. discloses the design for a portable golf ball washer.

Although each of the above referenced inventions achieves its individual objective, none of them discloses a portable ball washer wherein the cleaning implement is separable from the associated container. Such a construction allows a user to manually control the implement thereby leading to a more thorough ball cleaning. Furthermore, none of the above referenced inventions discloses a golf ball cleaning implement which is removably positioned within a water tight container.

Therefore, it is an object of this invention to provide an improvement which overcomes the aforementioned inadequacies of the prior art devices and provides an improvement which is a significant contribution to the advancement of the art.

Another object of this invention is to provide a means for allowing golfers to conveniently clean their golf balls at any location on a golf course.

Another object of this invention is to provide an implement which allows golfers to manually clean a golf ball.

Yet another object of this invention is to provide a golf ball cleaning implement which is adapted to be selectively positioned within a water tight enclosure.

Still yet another object of this invention is to provide a golf ball cleaning apparatus which is adapted to be worn on the belt of a user.

Another object of the present invention is to provide a golf ball cleaning implement which can be removed from its container without the user's hands coming into contact with the cleaning fluid.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention can be gained with reference to the detailed description of the preferred embodiment in addition to the scope of the invention defined by the claims taken in conjunction with the accompanying drawings.

SUMMARY OF THE INVENTION

For the purpose of summarizing this invention, this invention comprises a golf ball cleaning apparatus that is adapted for use while playing a game of golf. The apparatus employs a rectangular container defined by a closed lower end, an opened upper end, forward and rearward faces. The opened upper end is preferably formed at an angle to aid in accessing the interior of the container. The container is also preferably water tight and houses a volume of wash fluid. A spring biased clip is secured to a rearward face of the container and allows the entire apparatus to be worn on the belt of a user.

The container can be selectively closed by way of a rectangular lid. A female latch portion is formed upon a forward face of the lid and is adapted to mate with a male latch portion formed on the forward face of the container. A hinge pivotally interconnects the rearward opened end of the lid to the rearward opened end of the container. The lid thus has a closed orientation overlying the opened end of the container with the male and female latch portions engaged, and an opened orientation wherein the lid is pivoted away from the opening of the container and the male and female latch portions are unengaged.

The container and lid cooperate to selectively house a cleaning sponge. When positioned within the container, the sponge absorbs the cleaning fluid within the container. Thus, once the sponge is removed from the container it can be used to clean the surface of a golf ball. An elongated tab is interconnected to an upper extent of the sponge and allows a user to remove the sponge from the container without contacting the cleaning fluid.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 3 is a perspective view of the secondary embodiment of the present invention secured to the belt of a user.

FIG. 4 is a front elevational view of the secondary embodiment of the present invention.

FIG. 5 is a side elevational view of the secondary embodiment of the present invention taken along line 5—5 of FIG. 4.

FIG. 6 is an exploded perspective view of the secondary embodiment of the present invention.

Similar reference characters refer to similar parts throughout the several views of the drawings.

DETAILED DESCRIPTION OF THE PREFERRED EMBODIMENT

The present invention relates to a golf ball cleaning apparatus that is adapted to be worn on the belt of a user. The apparatus permits its wearer to easily clean a golf ball at any point during a round of golf. The apparatus includes a water tight container with a hinged lid which houses a volume of cleaning fluid. A cleaning implement, such as a sponge, is removably positioned within the container such that it comes into contact with, and absorbs, the cleaning fluid. Thereafter, the implement can be removed from the container and used to clean the surface of a golf ball. The various details of the present invention, and the manner in which they interrelate, will be described in greater detail hereinafter.

Figure 1:
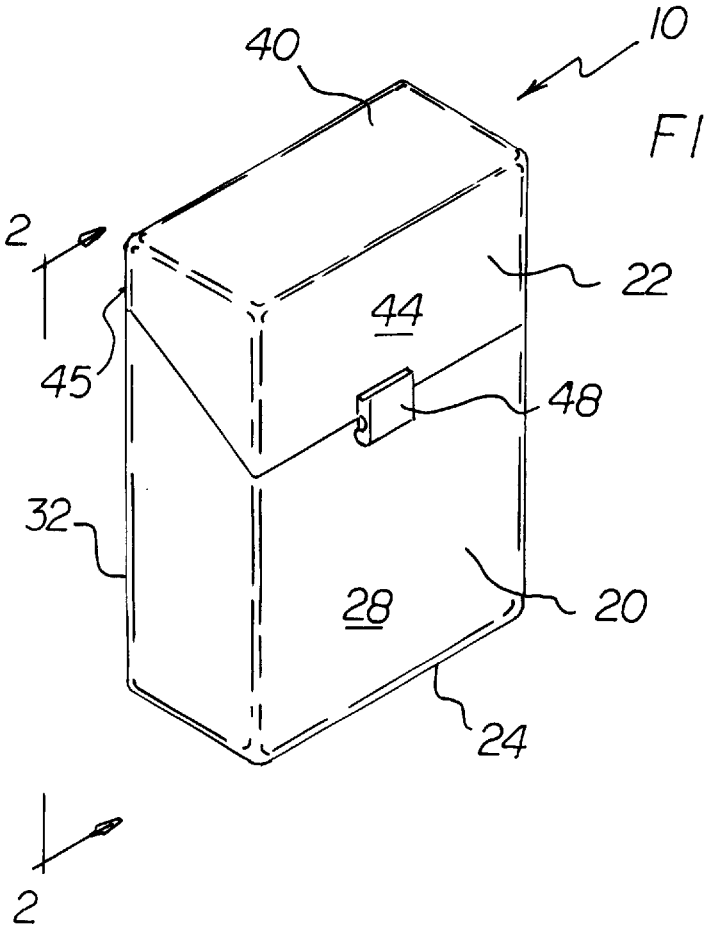
FIG. 1 is a perspective illustration of the preferred embodiment of the present invention.

With reference to FIG. 1, the preferred embodiment of the cleaning apparatus 10 is depicted. The apparatus 10 includes a container portion 20 and a hingedly interconnected lid portion 22. In the preferred embodiment, the container and lid portion together form a rectangular configuration. More specifically, the container and lid together form a cigarette type package, approximately the size of a standard beeper.

The container 20 is defined by a closed lower end 24 and an opened upper end 26 as well as forward and rearward faces, 28 and 32 respectively. Preferably, as noted in FIG. 2, the opened upper end 26 of the container 20 is formed at an angle. As such, the rearward end of the opening is higher, and disposed above, the forward end of the container 20. This angled opening 26 increases the surface area of the opening, and thereby provides a more convenient access to the contents of the container 20. By contrast, a non-angled opening provides an opening of lesser surface area. Nonetheless, the use of a non-angled opening is within the scope of the present invention. The container 20 functions in retaining a volume of wash fluid 34. This wash fluid 34 can be any type of washing fluid known in the art such as soap and water or ammonia and water. The only requirement of the washing fluid 34 is that it be sufficient to clean dirt from the surface of a golf ball. The container is also water tight such as to prevent the escape of the wash fluid 34. In this regard, the container 20 and associated lid 22 are preferably formed from a lightweight plastic and can be closed to form a water tight vessel.

Figure 2:
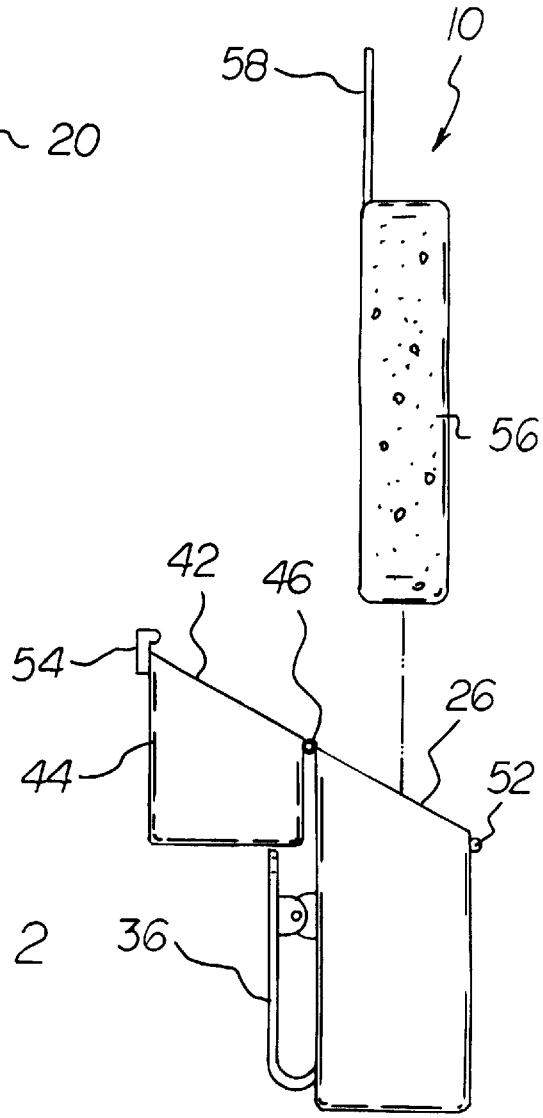
FIG. 2 is a side elevational view of the apparatus taken along line 2—2 of FIG. 1.

FIG. 2 illustrates the spring biased clip 36 which is secured to the rearward face 32 of the container 20. This clip 36 is pivotally secured and biased into a closed orientation such that the distal end of the clip is in contact with the rearward face 32 of the container 20. The bias of the spring can be overcome by depressing the opposite end of the clip 36 to thereby pivot the clip open. In the preferred embodiment, the clip 36 is sized to be secured over the belt 38 of a wearer. Thus, the clip 36 can be pivoted to the opened orientation and then secured over the belt 38 of a wearer. The subsequent release of the clip 36 causes the spring force to close the clip 36, and thus, secure the clip 36 to the wearer's belt 38.

The lid 22 of the apparatus 10 is described in conjunction with FIGS. 1 and 2. The lid 22 is defined by a closed upper end 40 and an opened lower end 42, a forward (or first) face 44 and a rearward (or second) face 45. As with the container 20, the opened end 42 of the lid 22 is formed at an angle, with the angle of the container opening 26 matching the angle of the lid opening 42. Thus, the rearward (or second) end of the lid opening is higher than the forward (or first) end of the lid opening. As a result of the matching angled openings of the container and lid, the apparatus 10 has a smooth rectangular shape with the lid 22 in the closed orientation.

FIG. 2 illustrates the hinge 46 that is employed in interconnecting the container 20 and lid 22. This hinge 46 is pivotally interconnected to the rearward opened end of the lid 22 and the rearward opened end of the container 20. In the preferred embodiment the hinge 46 is a door-type hinge. As can be appreciated, the hinged pivotal interconnection between the container 20 and the lid 22 gives the apparatus 10 both a closed and an opened orientation. In the closed orientation, the lid 22 overlies the opened end 26 of the container 20. In other words, in the closed orientation, the opened end 26 of the container 20 is in facing relationship with the opened end 42 of the lid 22.

The fastening device 48 of the apparatus is described next. The fastening device 48 is made up of male and female latch portions, 52 and 54 respectively. As illustrated in FIGS. 1 and 2, the male latch portion 52 is formed upon the forward face 28 of the container 20 adjacent the opened end 26. Similarly, the female latch portion 54 is formed upon the forward face 44 of the lid 22 adjacent the opened end 42. The female latch portion 54 is adapted to engage the male latch portion 52 when the lid is closed. More specifically, the female latch portion 54 is adapted to be biased outwardly and positioned over the male latch portion 52. With the two latch portions (52 and 54) so engaged, the lid 22 is prevented from unintentionally opening. In order to subsequently open the lid 22, the female portion 54 must be pivoted slightly to disengage it from the male latch portion 52. Thereafter, the lid 22 can be pivoted to the opened orientation. FIG. 2 illustrates the lid 22 in its opened orientation.

As indicated, the container 20 is specifically adapted to receive a cleaning sponge 56. This sponge 56 is preferably rectangular in shape. Nonetheless, the use of cleaning sponges of other shapes is within the scope of the present invention. This sponge 56 can be employed by a user to clean the surface of a golf ball. In the preferred embodiment, the sponge 56 has a height which is taller than the height of the container 20. As such, when the lid 22 is in the opened orientation, and the sponge 56 is positioned within the container 20, the upper portion of the sponge 56 is disposed above the opened upper end 26 of the container 20. This size relationship between the sponge 56 and container 20 facilitates removing the sponge 56 from the container 20. Retrieval of the sponge 56 is further facilitated by way of an elongated tab 58. This tab 58 is interconnected to the upper extent of the sponge 56 and is accessible with the lid 22 in the opened orientation. The tab 58 provides a convenient means by which the sponge 56 can be removed from, or placed within, the container 20. The tab 58 is preferably formed from a fabric material which does not absorb water. Consequently, the tab 58 constitutes a means by which the user can remove the sponge 56 from the container without coming into contact with the cleaning fluid 34.

FIGS. 3–6 illustrate a secondary embodiment 62 of the present invention. In this embodiment, the apparatus takes an oval configuration. Namely, the lid 22 and container 20 come together to form an oval. In all other respects, the embodiment depicted in FIGS. 3–6 is similar to the embodiment of FIGS. 1 and 2.

In use, a user would secure the apparatus 10 of the present invention to their belt 38 by way of the clip 36. With the lid 22 secured to the container 20 by way of the mating latch portions 52 and 54, a fluid tight vessel is formed. This vessel houses both the cleaning fluid 34 as well as the cleaning sponge 56. With the sponge 56 so secured within the apparatus 10, the cleaning fluid 34 is absorbed into, and retained by, the sponge 56. Thus, the sponge is damp when employed to clean the surface of a golf ball. During the course of a golf game, the lid 22 can be pivoted to its opened orientation to thereby give access to the cleaning sponge 56. The user can then remove the sponge 56 from the container 20 by way of the tab 58. The sponge 56 can then be used to manually clean the surface of a golf ball, with the cleaning fluid 34 retained within the sponge 56 acting as a solvent. Finally, the sponge 56 can then be replaced within the container 20, and the lid 22 closed, such that the sponge 56 can be used for further cleaning at a subsequent time. At the end of a golf game, or at other times as needed, the volume of wash fluid 34 can be poured out of the container 20 and replaced with clean wash fluid 34. In this manner, a user can ensure that the sponge 56 retains only clean wash fluid.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A golf ball cleaning apparatus adapted for use while playing a game of golf, the cleaning apparatus comprising:

a rectangular container having a closed lower end, an opened upper end, forward and rearward faces, and a height, the opened upper end defining an opening having forward and rearward ends, the opening being formed at an angle with the rearward end of the opening being higher than the forward end, a volume of cleaning fluid disposed within the container, a male latch portion being formed on the forward face of the container adjacent the opened upper end;

a spring biased clip secured to the rearward face of the container, the clip being adapted to be worn on a belt of a wearer;

a rectangular lid having a closed end and an opened end, first and second faces, the opened end defining an opening having first and second ends, the opening being formed at an angle with the second end of the opening being higher than the first end of the opening, a female latch portion formed upon the first face of the lid adjacent the opened end, a hinge pivotally interconnecting the second face of the lid adjacent the opened end to the rearward face of the container adjacent the opened upper end such that the lid has a closed orientation overlying the opened upper end of the container with the male and female latch portions engaged, and an opened orientation with the lid pivoted away from the opening of the container and the male and female latch portions unengaged;

a rectangular cleaning sponge adapted for use in cleaning golf balls positioned within the container, the sponge having a height which is taller than the height of the container such that a portion of the sponge is accessible with the lid in the opened orientation, an elongated tab interconnected to an upper extent of the sponge, the tab allowing a user to remove the sponge from the container without contacting the cleaning fluid.

2. A golf ball cleaning apparatus comprising:

a container having a height, a closed lower end and an opened upper end and forward and rearward faces, a volume of cleaning fluid disposed within the container, wherein the opened upper end of the container defines an opening having forward and rearward ends, wherein the opened upper end is formed at an angle with the rearward end of the opening being higher than the forward end, and a lid having a closed end and an opened end, wherein the opened end of the lid forms an opening with first and second ends, the opened end of the lid being likewise formed at an angle with the second end of the opening being higher than the first end of the opening, a hinge pivotally interconnecting the opened end of the lid to the opened upper end of the container such that the lid has a closed orientation overlying the opened upper end of the container and an opened orientation wherein the lid is pivoted away from the opened upper end of the container;

a cleaning sponge adapted for use in cleaning golf balls removably positioned within the container.

3. The golf ball cleaning apparatus as described in claim 2 wherein a male latch portion is formed on the forward face of the container adjacent the opened upper end, and wherein a female latch portion is formed upon a first face of the lid adjacent the opened end and wherein the male and female latch portions are engaged with the lid in the closed orientation.

4. The golf ball cleaning apparatus as described in claim 2 further comprising a spring biased clip secured to the rearward face of the container, the clip being adapted to be worn on the belt of a wearer.

5. The golf ball cleaning apparatus as described in claim 2 wherein the sponge is taller than the height of the container such that a portion of the sponge is accessible with the lid in the opened orientation.

6. A golf ball cleaning apparatus comprising:

a container having a height, a closed lower end and an opened upper end and forward and rearward faces, a volume of cleaning fluid disposed within the container, wherein the opened upper end of the container defines an opening having forward and rearward ends, wherein the opened upper end is formed at an angle with the rearward end of the opening being higher than the forward end a lid having a closed end and an opened end, wherein the opened end of the lid forms an opening with first and second ends, the opened end of the lid being likewise formed at an angle with the second end of the opening being higher than the first end of the opening, a hinge pivotally interconnecting the opened end of the lid to the opened upper end of the container such that the lid has a closed orientation overlying the opened upper end of the container and an opened orientation wherein the lid is pivoted away from the opened upper end of the container;

a cleaning sponge adapted for use in cleaning golf balls removably positioned within the container, wherein an elongated tab is interconnected to an upper extent of the sponge, the tab allowing a user to remove the sponge from the container without contacting the cleaning fluid.

7. The golf ball cleaning apparatus as described in claim 6 wherein the container and lid together have an oval configuration.

* * * * *